US011993299B2

(12) United States Patent
Muthusami et al.

(10) Patent No.: US 11,993,299 B2
(45) Date of Patent: May 28, 2024

(54) VEHICLE BRAKE CONTROL SYSTEM AND METHOD

(71) Applicant: Transportation IP Holdings, LLC, Norwalk, CT (US)

(72) Inventors: Srivallidevi Muthusami, Fort Worth, TX (US); Mahesh Babu Natarajan, Bengaluru (IN)

(73) Assignee: Transportation IP Holdings, LLC, Norwalk, CT (US)

( * ) Notice: Subject to any disclaimer, the term of this patent is extended or adjusted under 35 U.S.C. 154(b) by 378 days.

(21) Appl. No.: 17/370,934

(22) Filed: Jul. 8, 2021

(65) Prior Publication Data

US 2023/0007902 A1 Jan. 12, 2023

(51) Int. Cl.

| | |
|---|---|
| ***B61L 27/20*** | (2022.01) |
| ***B61L 15/00*** | (2006.01) |
| ***B61L 23/00*** | (2006.01) |
| ***B61L 25/02*** | (2006.01) |
| ***B61L 27/16*** | (2022.01) |

(52) U.S. Cl.

CPC ..... *B61L 27/20* (2022.01); *B61L 15/0054* (2013.01); *B61L 15/0062* (2024.01); *B61L 23/00* (2013.01); *B61L 25/023* (2013.01); *B61L 27/16* (2022.01); *B61L 15/0027* (2013.01); *B61L 2201/02* (2013.01)

(58) Field of Classification Search

None

See application file for complete search history.

(56) References Cited

U.S. PATENT DOCUMENTS

| | | | | |
|---|---|---|---|---|
| 5,020,862 | A * | 6/1991 | Balukin | B60T 13/665 303/86 |
| 6,666,411 | B1 * | 12/2003 | Hart | B61L 27/20 246/182 R |
| 10,259,478 | B1 * | 4/2019 | Gao | B61L 27/20 |
| 10,501,102 | B2 * | 12/2019 | Chung | B61L 15/0027 |
| 11,208,129 | B2 * | 12/2021 | Kumar | H04N 23/661 |

(Continued)

FOREIGN PATENT DOCUMENTS

| | | | | |
|---|---|---|---|---|
| AU | 2022203924 | A1 * | 2/2023 | B61L 15/0054 |
| BR | 102017006667 | A2 * | 12/2017 | B61L 27/0072 |

(Continued)

OTHER PUBLICATIONS

First Examination Report for related AU App No. 2022203924 dated Nov. 3, 2023 (4 pages).

*Primary Examiner* — Kevin R Steckbauer

(74) *Attorney, Agent, or Firm* — K&L Gates LLP

(57) ABSTRACT

A vehicle control system includes a controller disposed onboard a first vehicle system and comprising one or more processors. The controller is operably connected to a propulsion and braking subsystem of the first vehicle system. The controller is configured to analyze a notification message received from an off-board source as the first vehicle system travels on a route. The notification message identifies an unplanned brake application made by a second vehicle system. In response to the notification message, the controller is configured to control the propulsion and braking subsystem to modify movement of the first vehicle system based at least in part on a location of the second vehicle system to avoid the second vehicle system.

20 Claims, 3 Drawing Sheets

(56) References Cited

U.S. PATENT DOCUMENTS

| | | | | |
|---|---|---|---|---|
| 11,208,130 | B2 * | 12/2021 | Kernwein | G05D 1/0246 |
| 11,465,659 | B2 * | 10/2022 | Filippone | B61L 3/227 |
| 2003/0222180 | A1 * | 12/2003 | Hart | B61L 27/20 246/167 R |
| 2006/0041341 | A1 * | 2/2006 | Kane | B61L 15/0081 701/19 |
| 2018/0222505 | A1 * | 8/2018 | Chung | B61L 27/14 |
| 2019/0111953 | A1 * | 4/2019 | Gao | B61L 3/08 |
| 2019/0256113 | A1 * | 8/2019 | Filippone | B61D 15/12 |
| 2022/0055668 | A1 * | 2/2022 | Piparsaniya | B61L 15/0018 |
| 2022/0388555 | A1 * | 12/2022 | Zhang | B60T 17/228 |
| 2023/0007902 | A1 * | 1/2023 | Muthusami | B61L 25/023 |

FOREIGN PATENT DOCUMENTS

| | | | | | |
|---|---|---|---|---|---|
| CA | 2089220 | C | * | 9/2001 | B60T 13/665 |
| CA | 3128759 | A1 | * | 2/2022 | B61L 15/0018 |
| CN | 1461719 | A | * | 12/2003 | B61L 27/0038 |
| CN | 104583048 | A | * | 4/2015 | B60L 15/40 |
| CN | 104583048 | B | * | 8/2016 | B60L 15/40 |
| CN | 109178038 | A | * | 1/2019 | B61L 15/0027 |
| CN | 109664923 | A | * | 4/2019 | B61L 15/0027 |
| CN | 110536822 | A | * | 12/2019 | B61L 15/0027 |
| CN | 110979401 | A | * | 4/2020 | B60T 13/665 |
| CN | 112406963 | A | * | 2/2021 | B61L 25/025 |
| CN | 109664923 | B | * | 3/2021 | B61L 15/0027 |
| CN | 110979401 | B | * | 3/2021 | B60T 13/665 |
| CN | 112477929 | A | * | 3/2021 | B61L 27/0038 |
| CN | 114194251 | A | * | 3/2022 | |
| CN | 114559982 | A | * | 5/2022 | |
| CN | 114735047 | A | * | 7/2022 | |
| CN | 114735047 | B | * | 8/2022 | |
| CN | 115402385 | A | * | 11/2022 | |
| EP | 1366967 | A2 | * | 12/2003 | B61L 27/0038 |
| EP | 2778013 | B1 | * | 6/2016 | B61L 15/009 |
| EP | 3225500 | A1 | * | 10/2017 | B61L 27/0072 |
| EP | 3473523 | B1 | * | 1/2020 | B61L 15/0027 |
| FR | 3049557 | A1 | * | 10/2017 | B61L 27/0072 |
| WO | 2021134855 | A1 | | 7/2021 | |
| WO | WO-2021134855 | A1 | * | 7/2021 | B60T 13/665 |

* cited by examiner

VEHICLE BRAKE CONTROL SYSTEM AND METHOD

BACKGROUND

Technical Field

The subject matter described herein relates to systems and methods that control braking of vehicles.

Discussion of Art

There are several situations in which a vehicle traveling on a route makes an unplanned brake application to stop or slow down. For example, a control system onboard that vehicle may require the vehicle to make the unplanned brake application in response to detecting a violation of a predefined rule. The violation that triggers the unplanned brake application may involve the vehicle exceeding a speed limit, a failing to comply with a work zone slow order or time of day restriction, entering a particular block or segment of route without authority, failure of an operator to pass an alertness test, and/or the like. Another situation that may cause a vehicle to make an unplanned brake application to stop or at least substantially slow is an emergency situation, such as when a foreign object is detected on the route, a person onboard the vehicle has a medical event that requires immediate assistance, or the like.

With respect to rail vehicles, typically when a first vehicle is forced to make an unplanned brake application, the first vehicle communicates with a back office (e.g., dispatcher) to inform the back office of the unplanned brake application. The back office may then broadcast a notification to any other vehicles in the vicinity of the first vehicle. The human operators onboard the vehicles that receive the notification are tasked with the determining how to react to the new information. For example, each operator first determines whether the respective vehicle under the control of that operator is impacted by the unplanned braking of the first vehicle. If the respective vehicle is impacted, then the operator manipulates the vehicle throttle and brakes in order to slow the vehicle to avoid a collision with the first vehicle and preferably keep the vehicle outside of a safety buffer surrounding the first vehicle. This is an inaccurate, error-prone, and intensive, time-consuming procedure as it relies on human decision making, calculation, and control on the fly as the vehicle travels along the route.

Furthermore, due to the known fallibility of human operators, the vehicles that are impacted by the first vehicle often adopt an overly conservative speed reduction so that the vehicles slow earlier and/or to a greater extent (e.g., travel slower) than necessary to be able to stop outside of the restricted safety buffer surrounding the first vehicle. This conservative reaction by vehicles impacted by the first vehicle may increase traffic congestion by interfering with the scheduled movement of other vehicles in a transportation network that are unaffected by the first vehicle. The result is reduced travel efficiency and vehicle throughput within the transportation network.

BRIEF DESCRIPTION

In one or more embodiments, a vehicle control system is provided that includes a controller disposed onboard a first vehicle system and comprising one or more processors. The controller is operably connected to a propulsion and braking subsystem of the first vehicle system. The controller is configured to analyze a notification message received from an off-board source as the first vehicle system travels on a route. The notification message identifying an unplanned brake application made by a second vehicle system. In response to the notification message, the controller is configured to control the propulsion and braking subsystem to modify movement of the first vehicle system based at least in part on a location of the second vehicle system to avoid the second vehicle system.

In one or more embodiments, a method is provided that includes analyzing, via one or more processors disposed onboard a first vehicle system, a notification message received at the first vehicle system from an off-board source as the first vehicle system travels on a route. The notification message identifies an unplanned brake application made by a second vehicle system. The method includes controlling a propulsion and braking subsystem of the first vehicle system, via the one or more processors and independent of input from a human operator of the first vehicle system, to modify movement of the first vehicle system based at least in part on a location of the second vehicle system to avoid the second vehicle system.

In one or more embodiments, a vehicle control system is provided that includes a controller and a communication device both disposed onboard a first vehicle system. The controller including one or more processors and operably connected to a propulsion and braking subsystem of the first vehicle system. The communication device operably connected to the controller and configured to receive a notification message from an off-board source as the first vehicle system travels on a route. The notification message identifies an unplanned brake application made by a second vehicle system. The controller is configured to determine, based on a location of the second vehicle system, that the second vehicle system occupies an upcoming segment of the route on which the first vehicle system is traveling. In response, the controller is configured to control the propulsion and braking subsystem, independent of input from a human operator of the first vehicle system, to modify movement of the first vehicle system based at least in part on the location of the second vehicle system to avoid the second vehicle system.

BRIEF DESCRIPTION OF THE DRAWINGS

The inventive subject matter may be understood from reading the following description of non-limiting embodiments, with reference to the attached drawings, wherein below.

DETAILED DESCRIPTION

Figure 1:
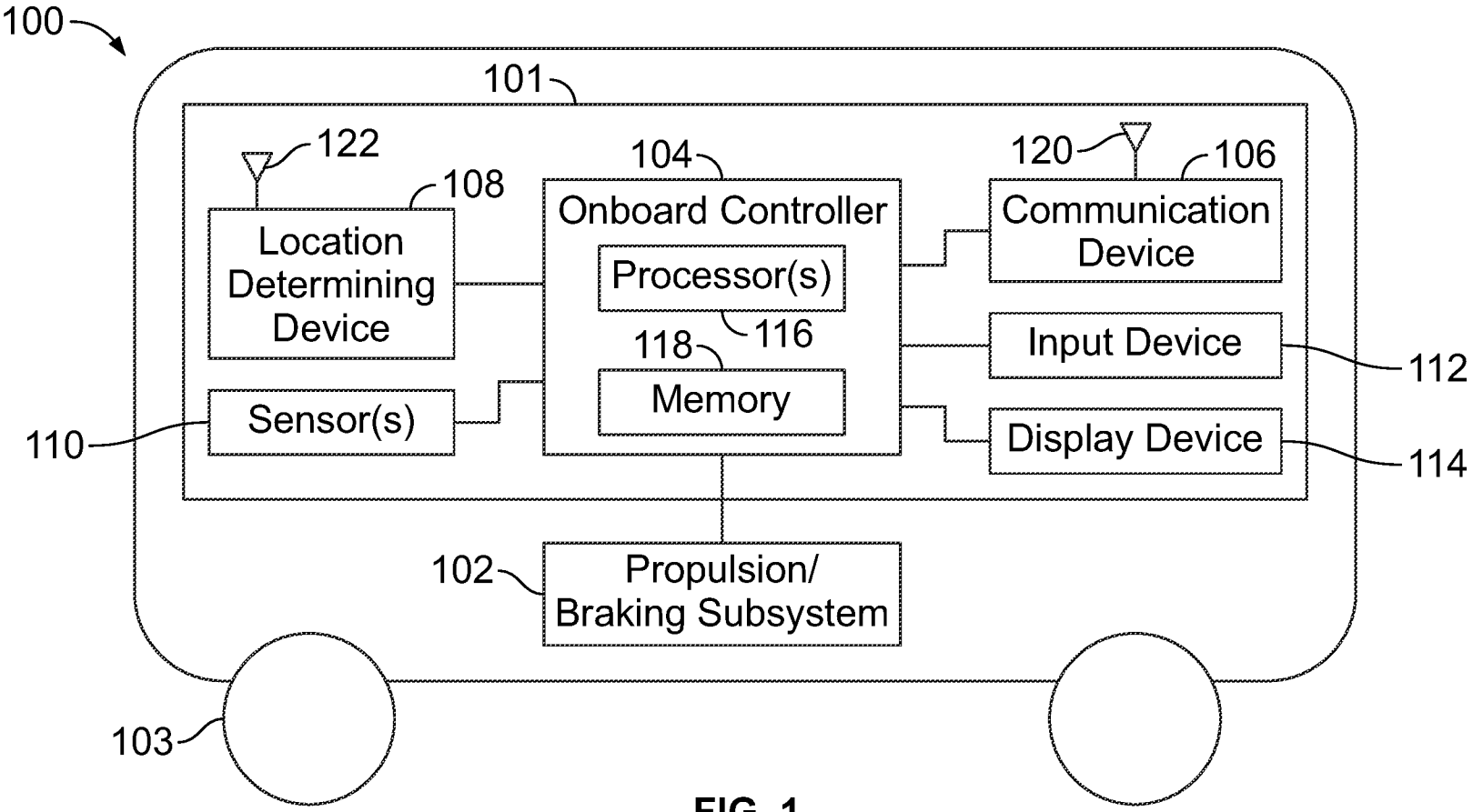
FIG. 1 is a schematic illustration of a vehicle control system according to one or more embodiments.

One or more embodiments described herein are directed to a system and method for automating the responsive actions taken by vehicles impacted by a vehicle that makes an unplanned brake application to avoid that vehicle. The system disclosed herein is a vehicle control system disposed onboard a vehicle in the vicinity of the vehicle that makes the unplanned brake application. The vehicle control system is configured to receive a notification message from an off-board source. The notification message provides information about the unplanned brake application, such as an identity of the vehicle that makes the unplanned brake application and/or a location of that vehicle. As used herein, the vehicle that makes the unplanned brake application is referred to as a stopped vehicle, although in some circumstances the vehicle that makes the unplanned brake application may be permitted to travel at a slow speed, such as less than 20 mph or less than 10 mph, without stopping. The notification message may represent an enforcement notification that issues as a penalty in response to a violation by the stopped vehicle or an operator on the stopped vehicle.

The vehicle control system disclosed herein is configured to determine whether the respective host vehicle, on which the vehicle control system is disposed, is impacted by the stopped vehicle. For example, the vehicle control system calculates whether continued and/or planned movement of the host vehicle along a scheduled route would cause the host vehicle to approach the stopped vehicle and potentially collide with the stopped vehicle or at least enter into a restricted safety buffer zone surrounding the stopped vehicle. If the vehicle control system determines that the host vehicle is indeed impacted, then the vehicle control system can control the host vehicle to modify the movement of the host vehicle, to avoid colliding with and entering the safety buffer zone of the stopped vehicle. This control operation may involve a series of relatively complex physics equations that are computed by one or more processors of the control system in real-time as the host vehicle travels on the route. For example, rather than merely applying brakes to immediately slow the host vehicle upon determining that the host vehicle is impacted by the stopped vehicle, the vehicle control system described herein may calculate one or more control strategies for avoiding the stopped vehicle without the host vehicle traveling unnecessarily slow and/or stopping. The control strategies generated by the control system herein provide more efficient vehicle travel and less congestion in the transportation network (e.g., greater vehicle throughput), than systems controlled entirely by human operators and systems that take immediate, overly conservative responsive actions, which unduly delays completion of a trip by the host vehicle and can also interfere with the scheduled trips of other vehicles.

The vehicle control system disclosed herein is automated so that in at least one embodiment the control system controls the movement of the vehicle system independent of an input of a human operator of the vehicle system. For example, the control system may automatically control tractive effort and/or braking of the vehicle system even if no operator input signals are received. Optionally, the vehicle control system may display a prompt for the human operator that alerts the operator of the stopped vehicle and provides at least one suggested control strategy. If the operator provides an input to select a control strategy, the vehicle control system may implement that control strategy. On the other hand, if the operator does not respond within a designated time period, the vehicle control system may automatically implement a preferred or recommended control strategy to control the host vehicle to avoid the stopped vehicle. The system may control the braking even if operator input is received. For example, the system may be configured to ignore or refuse operator input that is contrary to the recommended control operation, or may change an operator input to safely operate, such as by modifying an operator input to match or more closely align with the operations determined by the system. In at least one embodiment, the vehicle control system may be functionable on an autonomous vehicle that is not controlled by a human operator.

At least one technical effect of the vehicle control system and method disclosed herein is a reduced manual demand because operators are no longer required to modify vehicle movement during a trip to avoid other vehicles that make unplanned brake applications. Another technical effect may be increased safety that is inherent in shifting responsibility for reacting to an unplanned stoppage from a fallible human operator to a more reliable computing system.

Yet another technical effect is improved accuracy in the responsive vehicle movement and increased efficiency in vehicle throughout along a transportation network relative to human-based control of the vehicles. As briefly mentioned above, the vehicle control system can calculate a speed reduction profile for the vehicle, based on several parameters, constraints, and/or goals, to enable the host vehicle to smoothly slow to a stop at a target stopping location relative to the stopped vehicle without slowing earlier or more aggressively than necessary. The overly conservative speed reduction of impacted vehicles could reduce network throughput by unduly extending the trip duration of the host vehicle and/or obstructing the planned movement of other vehicles in the network. The vehicle control system can increase the accuracy, safety, and repeatability of such evasive maneuvers to mitigate unplanned vehicle stoppages on the route, relative to human operators, which beneficially enables the transportation network to enforce narrower safety buffers between vehicles. The narrower safety buffers allow the vehicle systems to travel in closer proximity to each other, relative to wider safety buffers, which also increases the efficiency and throughput of the transportation network.

The vehicle control system disclosed herein does not merely automate a process previously performed entirely by a human operator. For example, the control system is able to perform physics-based computations and modeling that a human operator is not practically capable of performing, particularly in real-time as the vehicle that receives notification message travels towards the stopped vehicle. A human operator would not be able to control the movement of the host vehicle to avoid the stopped vehicle with the same level of efficiency and accuracy as the vehicle control system. Furthermore, the vehicle control system is more reliable and repeatable than a human operator. The vehicle control system is able to take control of the host vehicle even if a human operator is negligent or incapacitated.

FIG. 1 is a schematic illustration of a vehicle control system 101 onboard a vehicle system 100 according to one or more embodiments. The vehicle system includes the vehicle control system and a propulsion and braking subsystem 102 for propelling the vehicle along a route and actively slowing the vehicle system. The vehicle control system includes an onboard controller or control circuit 104, a communication device 106, a location determining device 108, one or more sensors 110, an input device 112, and a display device 114. The controller is operably connected to the communication device, the location determining device, the one or more sensors, the input device, and the display device via wired and/or wireless communication pathways. The controller is also operably connected to the propulsion and braking subsystem of the vehicle system.

The onboard controller (referred to herein as controller) performs at least some of the operations described herein to modify the movement of the vehicle system in response to receiving a notification message that another vehicle system made an unplanned brake application. The controller represents hardware circuitry that includes and/or is connected with one or more processors 116 (e.g., one or more microprocessors, integrated circuits, microcontrollers, field programmable gate arrays, etc.). The controller includes and/or is connected with a tangible and non-transitory computer-readable storage medium (e.g., memory) 118 disposed onboard the vehicle system. The memory may store programmed instructions (e.g., software) that is executed by the one or more processors to perform the operations of the controller described herein. The memory additionally or alternatively may store different information, such as a route database, a trip schedule, a vehicle makeup or manifest, and/or the like.

The communication device represents hardware circuitry that can wirelessly communicate electrical signals. For example, the communication device can represent transceiving circuitry, one or more antennas 120, and the like. The transceiving circuitry may include a transceiver or a separate transmitter and receiver. The electrical signals can form data packets that in the aggregate represent messages. In an embodiment, the communication device is a radio that wirelessly communicates the electrical signals as radio frequency (RF) signals. The communication device can transmit or broadcast messages that are generated by the controller. The communication device can also receive messages and forward to the controller for analysis of the received messages. For example, the communication device may receive a notification message received from an off-board source. The notification message may identify an unplanned brake application made by a different (e.g., second) vehicle system in the vicinity of the host vehicle system, on which the vehicle control system is located.

The location determining device is configured to determine the respective location of the vehicle system at a given time. The vehicle system optionally may include multiple location determining devices spaced apart at different locations along the length of the vehicle system. For example, one location determining device may be located at a front of the vehicle system to determine the head of the vehicle location, and a second location determining device may be located at a rear of the vehicle system to determine an end of the vehicle location. The location determining device can include a receiver, at least one antenna 122, and associated circuitry. The location determining device may be configured to receive signals from satellites. For example, the device may be a global positioning system (GPS) receiver that generates a three-dimensional positional coordinate in a global coordinate system based on signals received from satellites. In an alternative embodiment, the location determining device can determine the respective location based on signals received from wayside devices and/or by estimating a distance from the location determining device to a reference device offboard the vehicle system that has a known location.

The one or more sensors can include various different types of sensors for monitoring certain conditions and parameters that can be used by the controller when calculating how to modify movement of the vehicle system in response to receiving a notification message that another vehicle system has made an unplanned brake application. The one or more sensors include a vehicle speed sensor for measuring the speed of the vehicle system relative to the route. The sensors may also include an accelerometer, a brake sensor that measures a force or pressure exerted by the friction brakes, current and/or voltage sensors associated with tractive motors, and/or the like. The sensors generate sensor data that is representative of the measured parameters, and the sensor data is transmitted as signals to the controller for analysis of the sensor data.

The input device can represent or include an onboard instrument panel, hand brake, steering wheel, throttle lever, throttle and/or brake pedal, computer, tablet computer, handheld computer, keyboard, touchpad, joystick, and/or the like for enabling a human operator to interact with the vehicle control system.

The display device can be an integrated display screen onboard the vehicle and/or a display screen on a personal, tablet, handheld (e.g., smartphone), or wearable (e.g., smartwatch) computer. The display device is configured to display visual information to a human operator concerning the movement of the vehicle system. In an embodiment, the controller controls the display device, via control signals, to generate and display a prompt that notifies the human operator that the vehicle control system has received a notification message that another vehicle system has made an unplanned brake application. The controller may also utilize the display device to provide a recommended course of operation or control strategy to the human operator, which the operator can select using the input device.

The propulsion and braking subsystem of the vehicle system represents the hardware components and any associated software used to provide work for propelling and slowing the vehicle system along the route. The propulsion system can include one or more traction motors, inverters, combustion engines, battery systems, air brake systems, friction brake systems, dynamic or regenerative brake systems (e.g., using motors), and/or the like. In the illustrated embodiment, the propulsion is provided by exerting a torque on wheels 103 of the vehicle system to rotate the wheels relative to the route.

Figure 2:
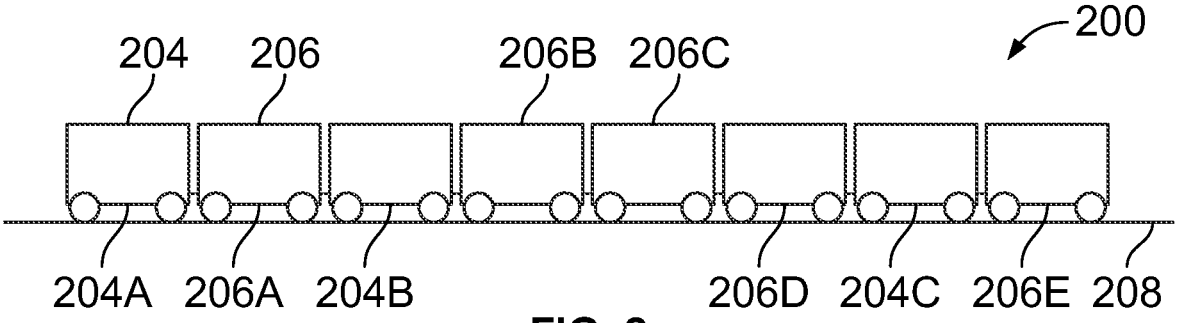
FIG. 2 illustrates a vehicle system on which the vehicle control system is disposed according to an embodiment.

FIG. 2 illustrates a vehicle system 200 on which the vehicle control system according to one or more embodiments herein can be implemented. For example, the vehicle system 200 may represent the vehicle system 100 shown in FIG. 1. The vehicle system in FIG. 2 includes several vehicles 204, 206 that travel along a route 208. Vehicles 204A-C represent propulsion-generating vehicles that generate tractive effort to propel the vehicle system along the route. Vehicles 206A-E represent non-propulsion-generating vehicles that do not generate tractive effort and do not contribute to the propulsion of the vehicle system. The non-propulsion-generating vehicles include brake systems but lack propulsion systems. The vehicle control system is disposed onboard at least one of the vehicles of the vehicle system, such as at least one of the propulsion-generating vehicles.

The non-propulsion-generating vehicles may be mechanically coupled to each other and to the propulsion-generating vehicles, such that the propulsion-generating vehicles propel the non-propulsion-generating vehicles along the route. The arrangement of the vehicles may vary. One or more of the non-propulsion-generating vehicles optionally may be disposed between propulsion-generating vehicles. The vehicle system may have as few as one propulsion-generating vehicle and as few as zero non-propulsion-generating vehicles. The vehicle system also may include more vehicles than shown in FIG. 2. In an alternative embodiment, the propulsion-generating vehicles are mechanically separate (e.g., are not directly or indirectly mechanically coupled to each other), but logically coupled. For example, the propulsion-generating vehicles may communicate with each other to coordinate movements so that the vehicles move together as a vehicle system (e.g., in a convoy).

In a non-limiting example, the vehicle system is a train, the vehicles are rail vehicles, and the route is a railroad track. The propulsion-generating vehicles are locomotives. The non-propulsion-generating vehicles may be rail cars that carry cargo and/or passengers. In another non-limiting embodiment, the vehicle system is a road train, and the route is a road or path. For example, the propulsion-generating vehicles may be trucks (e.g., highway semi-trucks, mining trucks, logging trucks, or the like), and the non-propulsion-generating vehicles may be trailers coupled to the trucks. In other embodiments, the vehicle system may include one or more other types of vehicles such as automobiles, buses, agricultural vehicles, marine vessels, or other off-highway vehicles (e.g., vehicles that are not legally permitted and/or are not designed for travel on public roadways).

Figure 3:
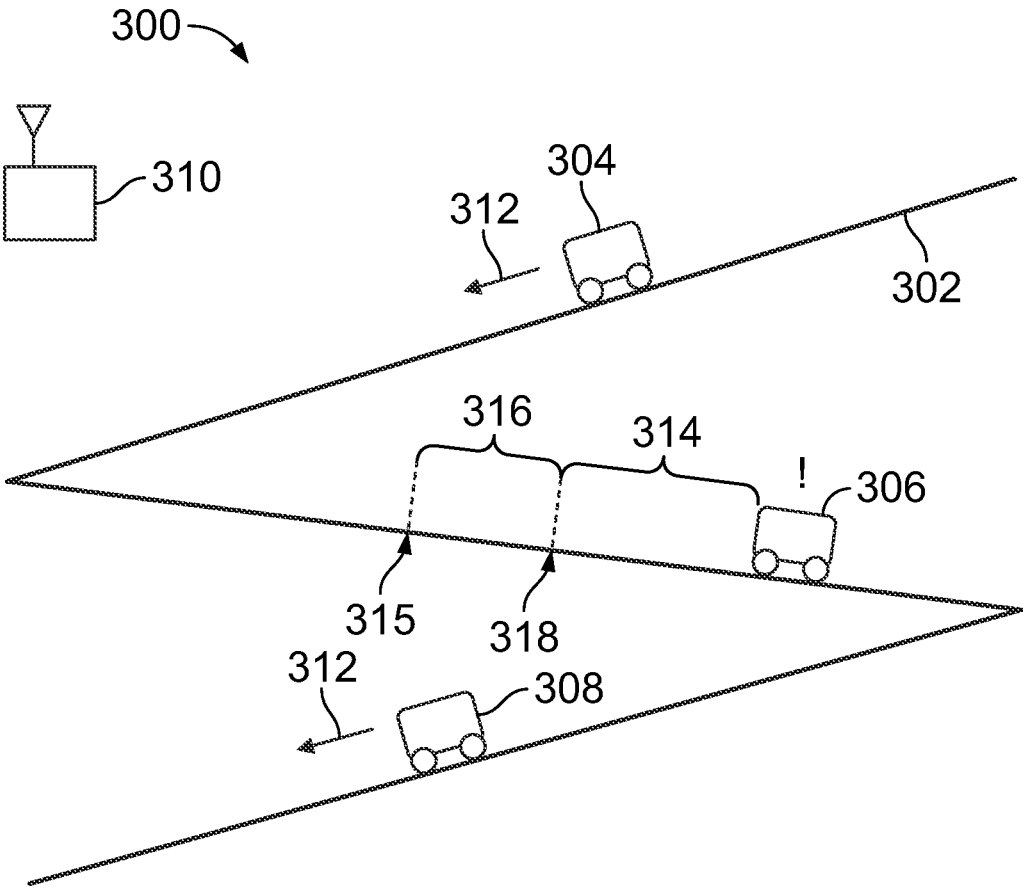
FIG. 3 illustrates a transportation system that has multiple vehicle systems traveling on a route according to an embodiment.

FIG. 3 illustrates a transportation system 300 that has multiple vehicle systems traveling on a route 302 according to an embodiment. The vehicle systems include a first vehicle system 304, a second vehicle system 306, and a third vehicle system 308. The vehicle control system 100 shown in FIG. 1 is disposed onboard the first vehicle system, and unless otherwise specified references to components of the vehicle control system represent components onboard the first vehicle system. Optionally, the second and third vehicle systems may also include similar onboard vehicle control systems as the first vehicle system. FIG. 3 shows the route as a single track or path for simplicity, although the transportation system may include a network of interconnected routes.

The transportation system 300 also includes at least one off-board computing system 310. The off-board computing system may include a communication device for communicating within the vehicle systems on the route. The off-board computing system may monitor the movement and locations of multiple vehicle systems traveling through the transportation system. In an embodiment, the off-board computing system is a server, such as a back-office server (BOS). The off-board computing system may be located at a wayside device proximate to the route or at a remote location, such as at a dispatch or traffic controller facility.

In an embodiment, the first vehicle system may receive a notification message while the first vehicle system travels along the route during a trip. The notification message identifies an unplanned brake application made by another vehicle system, which in this case is the second vehicle system 306. The notification message is received by the communication device of the vehicle control system onboard the first vehicle system. The notification message may be wirelessly communicated from an off-board source.

In an embodiment, the off-board computing system generates the notification message. For example, upon making an unplanned brake application, the second vehicle system may communicate an alert message to the off-board computing system to notify the off-board computing system. The off-board computing system then communicates the notification message to any vehicle systems in a vicinity of the second vehicle system. Both the first and third vehicle systems are in the vicinity of the second vehicle system, so both the first and third vehicle systems receive the notification message. In an embodiment, the notification message is wirelessly broadcasted. In an alternative embodiment, the off-board computing system directly communicates the notification message to the vehicle systems in the vicinity, by using a private one-to-one communication pathway and/or incorporating an intended recipient into the message. For example, the off-board computing system may monitor the locations of the vehicle systems over time. In response to receiving the alert message, off-board computing system may determine the intended recipients of the notification message based on which vehicle systems are within a designated vicinity range of the second vehicle system that made the unplanned brake application.

In an alternative embodiment, the notification message may be communicated directly from the second vehicle system to the first and third vehicle systems. For example, the second vehicle system may broadcast the notification message to any other vehicle systems in the vicinity of the second vehicle system.

The notification message contains information about the unplanned brake application by the second vehicle system. For example, the notification message may identify the vehicle that made the unplanned brake application, which is the second vehicle system in this example. The second vehicle system may be identified by a unique identifier that is associated with the second vehicle system. The information in the notification message may include a location of the second vehicle system, such as the location at which the second vehicle system is stopped or the location at which the second vehicle system make the brake application to slow the second vehicle system to a stop. The notification message may include a speed of the second vehicle system, particularly if the second vehicle system is not making a complete stop but rather is slowing to a slow speed, such as under 10 mph for at least a designated amount of time. The notification message may also include expected travel resumption characteristics of the second vehicle system. The expected travel resumption characteristics may include an expected amount of time that the second vehicle system will be stationary before resuming travel along the route, an expected time that the second vehicle system will resume travel, and/or acceleration characteristics of the second vehicle system (e.g., how fast the second vehicle system can achieve a designated travel speed from stop).

The unplanned brake application is a brake application that causes the vehicle system making the unplanned brake application to slow considerably, typically to a stop. As stated, the brake application is unplanned, meaning that the brake application represents a deviation from a trip plan or trip schedule. The stopped vehicle system may cause traffic congestion and may delay the completion of trips of other vehicle systems. The unplanned brake application may be a penalty brake application that is based on (e.g., predicated by) a violation committed by the second vehicle system. The violation may be that the vehicle system travels with a speed, noise, or other condition that exceeds a regulatory upper limit. The violation may be that the vehicle system exceeds its authority to enter a section of the route, such as a block or track segment. In another example, the violation may be caused by an operator or other crew member onboard the vehicle system, such as if the operator fails to comply with or satisfy a test for operator alertness. Optionally, a control system onboard the second vehicle system automatically triggers the unplanned brake application in response to detecting the violation, and automatically communicates the alert message to the off-board computing system and/or other vehicle systems in the vicinity in response to triggering the unplanned brake application. In another example, an operator onboard the second vehicle system may selectively activate the unplanned brake application, such as in the event of a medical emergency for a person onboard the second vehicle system, where that person needs immediate medical attention from personnel off-board the vehicle system.

The communication device onboard the first vehicle system receives the notification message and forwards the contents of the message to the controller of the vehicle control system. When the notification message is due to a violation of the second vehicle system, the notification message may be referred to as an enforcement notification. The enforcement notification indicates that the unplanned brake application is the result of enforcing a penalty on the vehicle system guilty of the violation.

The onboard controller of the first vehicle system receives and analyzes the notification message, or at least some of the contents thereof. Typically, the first vehicle system is traveling (e.g., actively moving) on the route when the first vehicle system receives the notification message. The controller initially determines whether the unplanned brake application of the second vehicle system affects or impacts the scheduled or planned movement of the first vehicle system on the route. For example, if the second vehicle system does not occupy an upcoming segment of the route on which the first vehicle system is traveling, then the first vehicle system can essentially ignore the notification message and continue traveling as scheduled.

The controller may determine whether the first vehicle system is an impacted recipient of the notification message by comparing the relative locations of the first and second vehicle systems, as well as the direction of travel of the first vehicle system relative to the location of the second vehicle. For example, the location of the second vehicle system may be provided in the contents of the notification message. Optionally, the notification message may only identify the second vehicle system, not the location of the second vehicle system, and the controller may be able to determine the location of the second vehicle system using the identity. For example, the controller may store in the memory received or detected locations of other vehicle systems over time, and can determine which of the known locations is associated with the unplanned brake application based on the identification in the notification message. The controller then compares the location of the second vehicle system to the current location and direction of travel of the first vehicle system. The current location of the first vehicle system can be determined using sensor signals (e.g., data) generated by the location determining device of the vehicle control system. The direction of travel can be determined, for example, by plotting the location of the first vehicle system over time on a map that shows the route.

Optionally, the controller may take into account other information when determining whether the first vehicle system is impacted by the unplanned brake application of the second vehicle system. For example, if there are multiple routes side by side in parallel, the controller may compare the specific route occupied by the second vehicle system to the specific route occupied by the first vehicle system to determine if the two vehicle systems occupy the same route. If the first vehicle system is on a different route than the second vehicle system, the first vehicle system is not impacted by the unplanned brake application. In an embodiment, if the two vehicle systems are on the same route, the first vehicle system is not able to go around the second vehicle system without exiting onto a different route. For example, the route may be railroad track. In another example, the route may be a one-lane road or a path that is not wide enough to permit one vehicle system passing another vehicle system.

In FIG. 3, the first vehicle system is traveling in a direction of travel 312 that is towards the location of the second vehicle system. The controller determines that the first vehicle system is indeed an impacted recipient of the notification message, which is affected by the second vehicle system. The controller may generate a reply message in response to the notification message which is communicated to the off-board source from which the notification message was received. The reply message identifies the vehicle system communicating the reply message and indicates that the respective vehicle system is affected and will avoid the second vehicle system. Upon determining that the first vehicle system is an impacted recipient, the controller then begins to determine how to modify the movement of the vehicle system to avoid the second vehicle system.

The controller optionally may generate a control signal for the display device to display an alert to the human operator that is in control of or at least supervising the trip of the first vehicle system. The displayed alert may simply state that a vehicle ahead made an unplanned brake application, and that the system is determining a recommended course of action. Optionally, the controller may wait to display the alert for the operator until one or more recommended courses of action have been generated and are ready to present to the operator. The display operations described herein are optional, as the embodiments described herein may be utilized on fully autonomous vehicle systems that do not have human operators.

The third vehicle system in FIG. 3 is traveling in the same direction 312 as the first vehicle system, but is on the other side of the second vehicle system relative to the first vehicle system. The third vehicle system is traveling away from the second vehicle system, not towards the second vehicle system. The third vehicle system is not an impacted recipient of the notification message. The non-impacted recipients, such as the control system on the third vehicle system, may respond to the notification message with a reply message that identifies the respective vehicle system communicating the reply message and indicates that the respective vehicle system is not affected by the second vehicle system making the unplanned brake application.

After determining that the first vehicle system is an impacted recipient of the notification message, the controller controls the propulsion and braking subsystem of the first vehicle system to modify movement of the first vehicle system to avoid the second vehicle system. For example, the controller controls the propulsion and braking subsystem by generating control signals that are conveyed to the propulsion-generating components and/or brake components of the first vehicle system. In an embodiment, the controller may control the propulsion and braking subsystem in response to the notification message independently of human intervention, such as by an operator onboard the first vehicle system. Optionally, the controller may generate a control signal for displaying a visual prompt on the display device that notifies the operator of a recommended control strategy for modifying the movement of the first vehicle system to avoid the second vehicle system. The operator may have the ability to edit or select the control strategy that is to be implemented, but the controller does not require input by the operator before controlling the propulsion and braking subsystem to modify the movement of the first vehicle system.

The controller modifies the movement of the first vehicle system by deviating from the current speed and/or a planned speed of the first vehicle system. The planned speed may refer to an upper speed limit for a segment of the route or a speed designated by a trip plan specific to the first vehicle system. The trip plan may designate tractive and brake settings for the first vehicle system to implement at different times and locations during the particular trip of the vehicle system. When the first vehicle system is traveling at a planned speed, the controller may modify the movement by slowing the first vehicle system below the planned speed. The first vehicle system may be slowed below the planned speed by braking the vehicle system, such as by applying friction brakes and/or activating regenerative braking (e.g., dynamic braking). The controller may slow the first vehicle system by generating a control signal that automatically controls valves and/or actuators that apply the friction brakes and/or automatically switches the traction motors to the regenerative braking mode.

The controller may also modify the movement of the first vehicle system, which slows the vehicle system, by delaying, skipping, or reducing a magnitude of a designated tractive setting. For example, the planned movement for the first vehicle system at a designated location along a trip, according to a trip plan, may be to accelerate at a first tractive effort provided by the propulsion and braking subsystem. In response to receiving the notification message, the controller may skip or ignore the command to accelerate at the designated location, so that the vehicle system coasts instead of accelerates. Alternatively, the controller may control the propulsion and braking system to accelerate at a second tractive effort, that is reduced relative to the first tractive effort that is commanded, so the first vehicle system accelerates less than the planned movement.

The controller determines the control strategy for modifying the movement of the first vehicle system based at least in part on the location of the second vehicle. For example, the controller utilizes the location of the second vehicle system to ensure that the first vehicle system stops before colliding with the second vehicle system. More specifically, the controller may ensure that the first vehicle system is able to stop at a location outside of a safety buffer zone 314 of the second vehicle system. The safety buffer zone represents an area extending from the second vehicle system for a designated length or distance along the route, in which other vehicles are restricted from entering. The safety buffer zone is based on the location of the second vehicle system, rather than a fixed area along the route. In an embodiment, the controller is configured to control the first vehicle system to ensure that the first vehicle system can stop outside of the restricted safety buffer zone and within a designated proximity boundary 315 relative to the second vehicle system.

In an embodiment, the controller determines a stopping location 318 for the first vehicle system that is based on the second vehicle system that made the unplanned brake application. The controller may determine the stopping location to be a designated distance along the route from the end of the second vehicle system closest to the first vehicle system. For example, the stopping location may be within a target stopping window 316 that is outside of the safety buffer zone of the second vehicle system and within the proximity boundary. For example, the target stopping window is defined as the area along the route between the proximity boundary and the safety buffer zone. Optionally, the stopping location that is determined may have a specific coordinate in a coordinate system, such as a specific longitude and latitude coordinates.

After determining the stopping location, the controller then determines control operations for controlling the first vehicle system to stop at the stopping location, or at least within a threshold tolerance range (e.g., 50 m, 100 m, of the like) of the stopping location. For example, the controller may input information such as the stopping location, vehicle makeup characteristics, vehicle braking characteristics, and a speed of the first vehicle system, to calculate a location along the route (or a time during the trip) that the first vehicle system will actuate a brake application to slow the first vehicle system to a stop at the determined stopping location. The vehicle makeup characteristics may include the estimated weight of the first vehicle system, which affects the momentum, and optionally may also include the length of the first vehicle system. The vehicle braking characteristics may include the number and type of brakes on the first vehicle system that would be activated during the brake application, as well as the braking force or torque applied by the brakes. For example, based on the weight of the vehicle system and the number and type of brakes exerting a designated force or torque on the wheelsets, the controller can determine the stopping distance required to stop the first vehicle system for a given speed of the first vehicle system. The stopping distance determination may be calculated using physics equations, a physics-based computer model, and/or real-world or laboratory-based experimental data.

After determining the location along the route and/or time during the trip to make the brake application, the controller automatically controls the propulsion and braking subsystem of the first vehicle system to make the brake application upon reaching that location and/or time to stop the first vehicle system at the stopping location. The controller operates independent of human input to avoid the risk of collision with the second vehicle system if a human operator is negligent, incapacitated, or makes a mistake. For example, the controller may operate the first vehicle system in contravention to an input provided by a human operator, if the operator input contrasts the control operations determined by the control system to avoid the second vehicle system. For example, the controller implements the brake application upon reaching the determined location along the route to enable stopping before reaching the second vehicle system, even if the operator actively tries to thwart the brake application. The controller is more reliable than a human operator. Optionally, the controller may display a prompt on the display device that instructs a human operator to make the brake application at the determined location and/or time during the trip for stopping the first vehicle system at the stopping location. If no input from the human operator is received within a threshold time period of the time at which the brake application should be made, the controller generates a control signal to the propulsion and braking subsystem to automatically make the brake application.

The controller may determine different speed reductions based on different speeds of the first vehicle system. For example, the speed of the first vehicle system affects the momentum and therefore the distance needed to bring the first vehicle system to a stop. The speed reduction refers to a braking operation. Determining a speed reduction may involve first determining the stopping location based on the location of the second vehicle system; then determining the time and/or distance required to bring the first vehicle system to a stop, which is based in part on the speed of the vehicle system; and finally determining, based on the previous two determinations and the current location of the first vehicle system, the time and/or location along the route at which to make the brake application to stop the first vehicle system at the stopping location. The distance necessary to bring the first vehicle system to a stop also depends on the level of braking effort.

The controller may implement the speed reduction in practice by controlling the timing and magnitude of a brake application. For example, the controller tracks the location of the first vehicle system over time during the trip using the location determining device, and actuates the brake application at a designated magnitude at a time that the first vehicle system reaches the determined braking location.

The controller may determine speed reductions (e.g., modified speed profiles) based on different speeds of the first vehicle system because the speed affects the stopping distance, and therefore the location and/or time at which to make the brake application. For example, the controller may determine a first location and/or time to make the brake application based on the first vehicle system continuing to travel along the route as planned (e.g., according to a speed profile dictated by a trip plan), and a second location and/or time to make the brake application, which is after the first location and/or time, based on the first vehicle system traveling slower than planned. The first vehicle system may travel slower than planned in response to receiving the notification message, to increase energy efficiency and/or reduce the likelihood of having to stop at the stopping location.

The primary goal or consideration of the controller is to avoid a collision with the second vehicle system that makes the unplanned brake application, and to avoid entering the restricted safety buffer zone of the second vehicle system. An ancillary or secondary goal of the controller may be to enhance vehicle throughput along the transportation network, such as by avoiding interfering with the scheduled movement of other vehicles in the network. For example, if the first vehicle system stops at the stopping location to avoid the second vehicle system, the stopped first vehicle system may cause other vehicle systems in the network to slow or stop until the first vehicle system is able to resume travel again.

In an embodiment, the controller may factor expected travel resumption characteristics of the second vehicle system, when determining how to modify the movement of the first vehicle system to avoid the second vehicle system that makes the unplanned brake application. For example, the controller may utilize the expected travel resumption characteristics of the second vehicle system to control the first vehicle system to avoid stopping due to the unplanned brake application of the second vehicle system. The unplanned brake application of the second vehicle system may have a set duration, particularly if the brake application is a penalty application due to a violation. For example, the second vehicle system may be permitted to resume travel along the route after coming to a stop and/or after remaining stopped for a predefined period. The expected travel resumption characteristics may include information about the unplanned brake application of the second vehicle system, such as the time that the unplanned brake application was made, the speed that the second vehicle system achieves (e.g., zero miles per hour if coming to a stop) due to the brake application, the period that the second vehicle system is expected to remain stopped or at the substantially reduced speed, and/or an estimated time that the second vehicle system will resume travel. At least some of the expected travel resumption characteristics may be included in the notification message. One or more of the expected travel resumption characteristics may be stored in the local memory of the vehicle control system onboard the first vehicle system.

Based on the resumption characteristics, the controller may determine (e.g., estimate or predict) a time at which the second vehicle system no longer impedes traffic along the route, such that the second vehicle system is traveling again along the route, and optionally traveling at planned speeds. Based on this estimated time and a proximity of the first vehicle system to the location of the second vehicle system, the controller can generate a control strategy for controlling the first vehicle system to arrive at the location of the second vehicle system within a designated time window after the estimated time that the second vehicle system will no longer impede traffic. For example, if the estimated time is 2 PM, then the controller may plan the movement of the first vehicle system, based on the distance to the stopped location of the second vehicle system, to arrive at that location after 2 PM but within a time window, such as 1 hour or 30 minutes, of that estimated time. If the second vehicle system starts traveling again by 2 PM as predicted, then if the first vehicle system arrives at the location where the second vehicle system was stopped by 2:20 PM, the first vehicle system should not have to stop at all. Avoiding a stop of the first vehicle system would improve network throughput, particularly for rail vehicles which take substantial time to start up and reach traveling speeds after a stop.

The control strategy to modify movement of the first vehicle system to arrive at the location at which the second vehicle system was stopped within a designated time window after a predicted time that the second vehicle system resumes travel may include designated tractive settings and brake settings to control the speed of the first vehicle system.

Another ancillary or secondary goal of the controller is to increase energy efficiency of travel along the route. According to the example above, if the controller predicts that the route will be clear if the first vehicle system can delay reaching the location of the second vehicle system by 15 minutes or so relative to moving at the planned speeds, the controller may switch to an efficiency mode. In the efficiency mode, the controller may conserve fuel and coast more than the planned movement of the first vehicle system according to speed limits and/or a trip plan that does not account for the unplanned brake application of the second vehicle system. The controller may slow the vehicle system relative to traveling at planned speeds, such as by using more regenerative braking and/or skipping or reducing the magnitude of tractive efforts generated by the propulsion and braking subsystem. For example, there is no reason to accelerate to get to an upper speed limit if that speed would force the first vehicle system to stop ahead to avoid the second vehicle system.

The controller may generate a control strategy or plan that uses regenerative braking, coasting, and the like to efficiently slow the first vehicle system along the route, relative to the planned movement of the first vehicle system, as the first vehicle system travels towards the second vehicle system. The control strategy may be designed so that the first vehicle system arrives at the stopped location of the second vehicle system within a designated time window after the second vehicle system is expected to resume normal travel, which enables the first vehicle system to avoid stopping. The time window is also designed to avoid the first vehicle system traveling unnecessarily slow towards the second vehicle system, which could unduly impede network throughput. For example, if the first vehicle system slows from 60 miles per hour (mph) to 10 mph for 10 miles, just to try to delay reaching the second vehicle system and stopping, the slowly moving first vehicle system may be worse for network throughput than traveling at a greater speed until the location at which the first vehicle system is controlled to apply the brakes to stop at the designated stopping location. For example, moving slowly for miles may cause traffic congestion worse than if the first vehicle system has to come to a temporary stop. The controller may utilize constraints, such as the time window at which to reach the location of the second vehicle system and a minimum speed limit, to ensure that the modified movement of the first vehicle system does not unduly impede the transportation network throughput.

Figure 4:
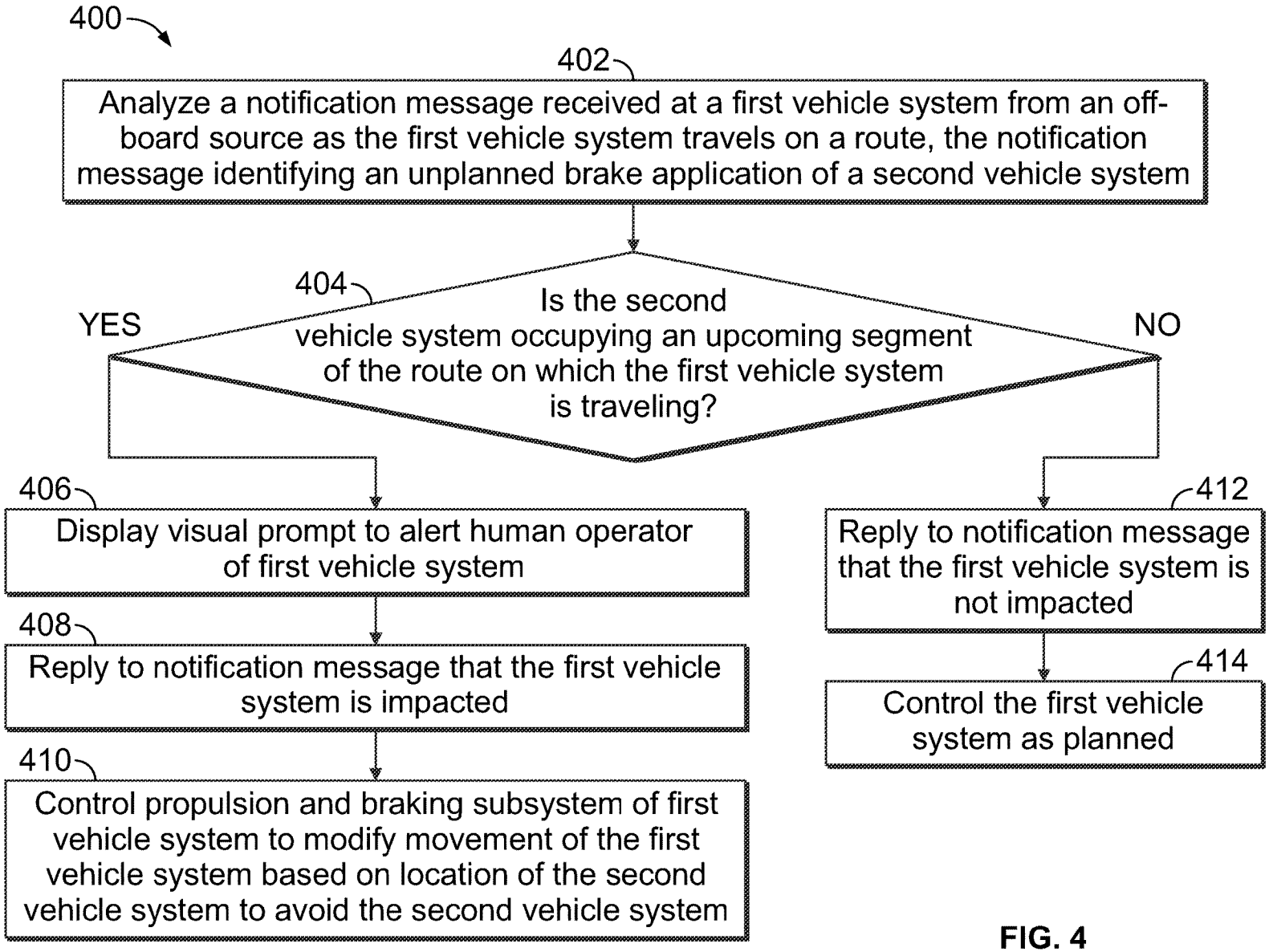
FIG. 4 is a flow chart of a method for controlling a vehicle system according to an embodiment.

FIG. 4 is a flow chart 400 of a method for controlling a vehicle system according to an embodiment. One or more operations or steps of the method may be performed by the vehicle control system shown in FIG. 1, particularly the onboard controller. The method may include more steps, fewer steps, and/or different steps than shown in FIG. 4. At 402, a notification message is analyzed via one or more processors disposed onboard a first vehicle system. The notification message is received at the first vehicle system from an off-board source as the first vehicle system travels on a route. The notification message identifies an unplanned brake application made by a second vehicle system. The notification message may be an enforcement notification that is generated by the second vehicle system or an off-board computing device, such as a back-office server (BOS).

At 404, a determination is made whether the second vehicle system occupies an upcoming segment of the route on which the first vehicle system is traveling. The determination may be made based on the location of the second vehicle system, the location of the first vehicle system, and optionally also a direction of travel of the first vehicle system. Without using the direction of travel, if the proximity between the relative locations of the two vehicle systems decreases over time, then it is determined that the second vehicle system does occupy the upcoming segment of the route traveled by the first vehicle system.

If the determination at 404 is positive, that the second vehicle does occupy the upcoming segment of the route traveled by the first vehicle system, then flow advances to 406. At 406, a visual prompt is displayed on a display device to alert a human operator of the first vehicle system that a vehicle system made an unplanned brake application ahead. The visual prompt is displayed on a display device, such as a computer or infotainment screen integrated onboard the first vehicle system, or a personal computing device of the operator, such as a smartphone, wearable device, or tablet.

At 408, a reply to the notification message is generated for communication to the off-board source from which the notification message that was received was communicated. The reply may identify the first vehicle system and indicate that the first vehicle system is an impacted recipient of the notification message, meaning that the first vehicle system will modify movement to avoid the second vehicle system that made the unplanned brake application/

At 410, the propulsion and braking subsystem of the first vehicle system are controlled to modify movement of the first vehicle system based at least in part on a location of the second vehicle system to avoid the second vehicle system. The propulsion and braking subsystem are controlled via the one or more processors and independent of human input.

Optionally, the method includes receiving sensor signals indicative of a speed of the first vehicle system and a location of the first vehicle system, and determining a speed reduction for the first vehicle system based at least on the speed of the first vehicle system, the location of the first vehicle system, and the location of the second vehicle system. The location of the second vehicle system may be provided in the notification message or determined using information within the notification message. The controlling of the propulsion and braking subsystem to modify movement of the first vehicle system at 410 may include implementing the speed reduction that is determined, such as by generating control signals to apply the brakes at a given location or time during the trip to cause the speed reduction.

Optionally, the controlling of the propulsion and braking subsystem to modify movement of the first vehicle system at 410 may include or represent slowing the first vehicle system to stop the first vehicle system at a stopping location that is outside of a restricted safety buffer zone of the second vehicle system and within a designated proximity boundary relative to the second vehicle system. Optionally, the controlling of the propulsion and braking subsystem to modify movement of the first vehicle system includes delaying, skipping, or reducing a magnitude of a designated tractive setting according to a trip plan that is implemented by the first vehicle system. Optionally, the controlling of the propulsion and braking subsystem to modify movement of the first vehicle system includes slowing the first vehicle system, based on the location of the second vehicle system and one or more expected travel resumption characteristics of the second vehicle system, to avoid stopping the first vehicle system due to the unplanned brake application of the second vehicle system.

If, at 404, it is determined that the second vehicle system is not occupying an upcoming segment of the route on which the first vehicle system is traveling, then flow advances to 412. At 412, a reply to the notification message is generated that identifies the first vehicle system and indicates that the first vehicle system is not impacted by the unplanned brake application of the second vehicle system. At 414, the first vehicle system, such as the propulsion and braking subsystem, are controlled as planned. The planned movement may involve traveling at a regulatory speed limit and/or traveling according to a trip plan that designated tractive and braking settings based on location, time, and/or distance along the route.

In one or more embodiments, a vehicle control system is provided that includes a controller configured to be operably connected to a propulsion and braking subsystem of a first vehicle system. The controller is configured to receive a notification message from an off-board source as the first vehicle system travels on a route. The notification message identifies an unplanned brake application made by a second vehicle system. In response to receiving the notification message, the controller is configured to control the propulsion and braking subsystem to modify movement of the first vehicle system based at least in part on a location of the second vehicle system to avoid the second vehicle system.

Optionally, the controller is configured to control the propulsion and braking subsystem based on the notification message independent of input from a human operator of the first vehicle system.

Optionally, the controller is configured to control the propulsion and braking subsystem to modify movement of the first vehicle system by stopping the first vehicle system at a stopping location that is outside of a restricted safety buffer zone of the second vehicle system and within a designated proximity boundary of the second vehicle system.

Optionally, the controller is configured to control the propulsion and braking subsystem to modify movement of the first vehicle system by one of delaying, skipping, or reducing a magnitude of a designated tractive setting to be implemented by the first vehicle system.

Optionally, the controller is configured to control the propulsion and braking subsystem to slow the first vehicle system, based on the location of the second vehicle system and one or more expected travel resumption characteristics of the second vehicle system, to avoid stopping the first vehicle system due to the unplanned brake application of the second vehicle system.

Optionally, the controller is configured to receive one or more sensor signals indicative of a speed and a location of the first vehicle system. The controller is configured to determine a speed reduction for the first vehicle system based at least on the speed of the first vehicle system, the location of the first vehicle system, and the location of the second vehicle system.

Optionally, the controller is configured to only modify the movement of the first vehicle system based on the notification message in response to determining that the second vehicle system occupies an upcoming segment of a route on which the first vehicle system is traveling.

Optionally, the notification message is an enforcement notification that describes a penalty brake application of the second vehicle system based on a violation committed by the second vehicle system.

Optionally, the vehicle control system further includes a communication device disposed onboard the first vehicle system and operably connected to the controller. The communication device is configured to receive the notification message from one of (a) an off-board computing system that is off-board both the first vehicle system and the second vehicle system or (b) the second vehicle system as the off-board source.

Optionally, the controller is further configured to generate a control signal for displaying a visual prompt on a display device based on the notification message.

Optionally, one or more of the first vehicle system or the second vehicle system is one or more rail vehicles.

In one or more embodiments, a method is provided that includes receiving, via one or more processors, a notification message at a first vehicle system from an off-board source as the first vehicle system travels on a route. The notification message identifies an unplanned brake application made by a second vehicle system. Responsive to receiving the notification message, the method includes controlling a propulsion and braking subsystem of the first vehicle system, via the one or more processors and independent of input from a human operator of the first vehicle system, to modify movement of the first vehicle system based at least in part on a location of the second vehicle system to avoid the second vehicle system.

Optionally, the method further includes determining, via the one or more processors, that the second vehicle system occupies an upcoming segment of the route on which the first vehicle system is traveling as a prerequisite before controlling the propulsion and braking subsystem to modify movement of the first vehicle system based on the location of the second vehicle system.

Optionally, controlling the propulsion and braking subsystem to modify movement of the first vehicle system comprises stopping the first vehicle system at a stopping location that is outside of a restricted safety buffer zone of the second vehicle system and within a designated proximity boundary of the second vehicle system.

Optionally, controlling the propulsion and braking subsystem to modify movement of the first vehicle system comprises delaying, skipping, or reducing a magnitude of a designated tractive setting to be implemented by the first vehicle system.

Optionally, controlling the propulsion and braking subsystem to modify movement of the first vehicle system comprises slowing the first vehicle system, based on the location of the second vehicle system and one or more expected travel resumption characteristics of the second vehicle system, to avoid stopping the first vehicle system due to the unplanned brake application of the second vehicle system.

Optionally, the method further includes receiving one or more sensor signals indicative of a speed and a location of the first vehicle system, and determining a speed reduction for the first vehicle system based at least on the speed of the first vehicle system, the location of the first vehicle system, and the location of the second vehicle system. Controlling the propulsion and braking subsystem to modify movement of the first vehicle system includes implementing the speed reduction that is determined.

In one or more embodiments, a vehicle control system is provided that includes a controller and a communication device both disposed onboard a first vehicle system. The controller comprises one or more processors and is operably connected to a propulsion and braking subsystem of the first vehicle system. The communication device is operably connected to the controller and is configured to receive a notification message from an off-board source as the first vehicle system travels on a route. The notification message identifies an unplanned brake application made by a second vehicle system. The controller is configured to determine, based on a location of the second vehicle system, that the second vehicle system occupies an upcoming segment of the route on which the first vehicle system is traveling. In response, the controller is configured to control the propulsion and braking subsystem, independent of input from a human operator of the first vehicle system, to modify movement of the first vehicle system based at least in part on the location of the second vehicle system to avoid the second vehicle system.

Optionally, the controller is configured to control the propulsion and braking subsystem to modify movement of the first vehicle system by stopping the first vehicle system at a stopping location that is outside of a restricted safety buffer zone of the second vehicle system and within a designated proximity boundary of the second vehicle system.

Optionally, the controller is configured to control the propulsion and braking subsystem based on the notification message in contravention to input from a human operator of the first vehicle system.

As used herein, the terms "processor" and "computer," and related terms, e.g., "processing device," "computing device," and "controller" may be not limited to just those integrated circuits referred to in the art as a computer, but refer to a microcontroller, a microcomputer, a programmable logic controller (PLC), field programmable gate array, and application specific integrated circuit, and other programmable circuits. Suitable memory may include, for example, a computer-readable medium. A computer-readable medium may be, for example, a random-access memory (RAM), a computer-readable non-volatile medium, such as a flash memory. The term "non-transitory computer-readable media" represents a tangible computer-based device implemented for short-term and long-term storage of information, such as, computer-readable instructions, data structures, program modules and sub-modules, or other data in any device. Therefore, the methods described herein may be encoded as executable instructions embodied in a tangible, non-transitory, computer-readable medium, including, without limitation, a storage device and/or a memory device. Such instructions, when executed by a processor, cause the processor to perform at least a portion of the methods described herein. As such, the term includes tangible, computer-readable media, including, without limitation, non-transitory computer storage devices, including without limitation, volatile and non-volatile media, and removable and non-removable media such as firmware, physical and virtual storage, CD-ROMS, DVDs, and other digital sources, such as a network or the Internet.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A vehicle control system comprising:

a controller configured to be operably connected to a propulsion and braking subsystem of a first vehicle system, the controller configured to receive a notification message from an off-board source as the first vehicle system travels on a route, the notification message identifying an unplanned brake application made by a second vehicle system that causes the second vehicle system to stop and a location of the second vehicle system, in response to receiving the notification message, the controller is configured to determine a rate at which to slow the first vehicle system based at least in part on the location of the second vehicle system to avoid stopping the first vehicle system and to avoid colliding with the second vehicle system, the controller further configured to control the propulsion and braking subsystem to slow the first vehicle system at the rate that is determined.

2. The vehicle control system of claim 1, wherein the controller is configured to control the propulsion and braking subsystem based on the notification message independent of input from a human operator of the first vehicle system.

3. The vehicle control system of claim 1, wherein, in response to determining that the rate of slowing the first vehicle system is insufficient to avoid stopping the first vehicle system, the controller is configured to control the propulsion and braking subsystem to stop the first vehicle system at a stopping location that is outside of a restricted safety buffer zone of the second vehicle system and within a designated proximity boundary of the second vehicle system.

4. The vehicle control system of claim 1, wherein, while the first vehicle system slows, the controller is configured to control the propulsion and braking subsystem to at least one of delay, skip, or reduce a magnitude of a designated tractive setting to be implemented by the first vehicle system.

5. The vehicle control system of claim 1, wherein the controller is configured to determine the rate at which to slow the first vehicle system based on the location of the second vehicle system and one or more expected travel resumption characteristics of the second vehicle system to avoid stopping the first vehicle system, wherein the one or more expected travel resumption characteristics include one or more of an expected amount of time that the second vehicle system will be stationary on the route, an expected time that the second vehicle system will resume travel on the route, or an acceleration characteristic of the second vehicle system from a stationary position.

6. The vehicle control system of claim 1, wherein the controller is configured to receive one or more sensor signals indicative of a speed and a location of the first vehicle system, the controller configured to determine the rate at which to slow the first vehicle system based at least on the speed of the first vehicle system, the location of the first vehicle system, and the location of the second vehicle system.

7. The vehicle control system of claim 1, wherein the controller is configured to only slow the first vehicle system based on the notification message in response to determining that the second vehicle system occupies an upcoming segment of Hall the route on which the first vehicle system is traveling.

8. The vehicle control system of claim 1, wherein the notification message is an enforcement notification that describes a penalty brake application of the second vehicle system based on a violation committed by the second vehicle system.

9. The vehicle control system of claim 1, further comprising a communication device disposed onboard the first vehicle system and operably connected to the controller, wherein the communication device is configured to receive the notification message from one of (a) an off-board computing system that is off-board both the first vehicle system and the second vehicle system or (b) the second vehicle system as the off-board source.

10. The vehicle control system of claim 1, wherein the controller is further configured to generate a control signal for displaying a visual prompt on a display device based on the notification message.

11. The vehicle control system of claim 1, wherein the first vehicle system includes one or more rail vehicles.

12. A method comprising:

receiving, via one or more processors, a notification message at a first vehicle system from an off-board source as the first vehicle system travels on a route, the notification message identifying an unplanned brake application made by a second vehicle system that causes the second vehicle system to stop and a location of the second vehicle system; and responsive to receiving the notification message, controlling a propulsion and braking subsystem of the first vehicle system via the one or more processors to slow the first vehicle system at a rate that is based at least in part on the location of the second vehicle system to avoid stopping the first vehicle system and to avoid colliding with the second vehicle system.

13. The method of claim 12, further comprising determining, via the one or more processors, that the second vehicle system occupies an upcoming segment of the route on which the first vehicle system is traveling as a prerequisite before controlling the propulsion and braking subsystem to slow the first vehicle system to avoid colliding with the second vehicle system.

14. The method of claim 12, wherein, in response to determining that the rate of slowing the first vehicle system is insufficient to avoid stopping the first vehicle system and avoid colliding with the second vehicle system, the method includes controlling the propulsion and braking subsystem to stop the first vehicle system at a stopping location that is outside of a restricted safety buffer zone of the second vehicle system and within a designated proximity boundary of the second vehicle system.

15. The method of claim 12, wherein, while the first vehicle system slows, the method comprises controlling the propulsion and braking subsystem to at least one of delay, skip, or reduce a magnitude of a designated tractive setting to be implemented by the first vehicle system.

16. The method of claim 12, further comprising determining the rate at which to slow the first vehicle system based on the location of the second vehicle system and one or more expected travel resumption characteristics of the second vehicle system to avoid stopping the first vehicle system, wherein the one or more expected travel resumption characteristics include one or more of an expected amount of time that the second vehicle system will be stationary on the route, an expected time that the second vehicle system will resume travel on the route, or an acceleration characteristic of the second vehicle system from a stationary position.

17. The method of claim 12, further comprising:

receiving one or more sensor signals indicative of a speed and a location of the first vehicle system; and determining the rate at which to slow the first vehicle system based at least on the speed of the first vehicle system, the location of the first vehicle system, and the location of the second vehicle system, wherein controlling the propulsion and braking subsystem to slow the first vehicle system includes implementing the rate that is determined.

18. A vehicle control system comprising:

a controller disposed onboard a first vehicle system and comprising one or more processors, the controller operably connected to a propulsion and braking subsystem of the first vehicle system; and a communication device disposed onboard the first vehicle system and operably connected to the controller, the communication device configured to receive a notification message from an off-board source as the first vehicle system travels on a route, the notification message identifying an unplanned brake application made by a second vehicle system that causes the second vehicle to stop, wherein the controller is configured to determine, based on a location of the second vehicle system, that the second vehicle system occupies an upcoming segment of the route on which the first vehicle system is traveling, and, in response, to control the propulsion and braking subsystem, independent of input from a human operator of the first vehicle system, to stop the first vehicle system at a stopping location that is outside of a restricted safety buffer zone of the second vehicle system and within a designated proximity boundary of the second vehicle system.

19. The vehicle control system of claim 18, wherein the controller is configured to control the propulsion and braking subsystem based on the notification message in contravention to input from a human operator of the first vehicle system.

20. The vehicle control system of claim 18, wherein the controller is configured to receive one or more sensor signals indicative of a speed of the first vehicle system and a location of the first vehicle system, the controller configured to determine a speed reduction rate for the first vehicle system to stop the first vehicle system at the stopping location based at least on the speed of the first vehicle system, the location of the first vehicle system, and the location of the second vehicle system.

* * * * *